US006425436B1

(12) United States Patent
Peting

(10) Patent No.: US 6,425,436 B1
(45) Date of Patent: Jul. 30, 2002

(54) SAND CORE BREAKING APPARATUS

(75) Inventor: Robert G. Peting, Oak Forest, IL (US)

(73) Assignee: AMSTED Industries Incorporated, Chicago, IL (US)

( * ) Notice: Subject to any disclaimer, the term of this patent is extended or adjusted under 35 U.S.C. 154(b) by 0 days.

(21) Appl. No.: 09/595,131

(22) Filed: Jun. 16, 2000

(51) Int. Cl.[7] ..... B22D 29/00
(52) U.S. Cl. ..... 164/345
(58) Field of Search ..... 164/132, 345, 164/286, 289, 292, 295, 302; 241/DIG. 10

(56) References Cited

U.S. PATENT DOCUMENTS

| | | | | | |
|---|---|---|---|---|---|
| 1,746,346 | A | * | 2/1930 | Giles | 164/345 |
| 3,612,162 | A | * | 10/1971 | Michel | 164/397 |
| 3,627,020 | A | * | 12/1971 | Taccone | 164/131 |
| 3,662,815 | A | * | 5/1972 | Bouyt | 164/292 |

FOREIGN PATENT DOCUMENTS

| | | | | |
|---|---|---|---|---|
| DE | 27 31 802 | * | 2/1979 | B22C/9/10 |
| FR | 2 707 901 | * | 1/1995 | B22C/9/10 |
| GB | 343652 | * | 2/1931 | 164/345 |

* cited by examiner

*Primary Examiner*—M. Alexandra Elve
*Assistant Examiner*—Kevin P. Kerns
(74) *Attorney, Agent, or Firm*—Edward J. Brosius

(57) ABSTRACT

An apparatus and method for extracting a cast iron pipe from a centrifugal casting machine and for also breaking the continuity of an annular sand core used to form the bell end of the pipe. The apparatus has a carrier member on which are mounted extractor carrier jaw assemblies and core continuity breaking members. The extractor jaw assemblies are movable between extended and retracted positions. One end of the carrier member is inserted into the bell end of the pipe while the pipe is in the casting machine. The extractor jaw assemblies are retracted as the carrier member enters the pipe. As the carrier member enters the pipe, the core continuity breaking members plow through parts of the sand core to break the continuity of the sand core. The extractor jaw assemblies are then extended to contact the interior surface of the pipe wall and the apparatus is retracted, pulling the pipe out of the mold in the casting machine. The sand core is broken into pieces and the chunks of the sand core fall out of the pipe. The pipe may then be processed in the normal manner.

13 Claims, 5 Drawing Sheets

SAND CORE BREAKING APPARATUS

BACKGROUND OF THE INVENTION

1. Field of the Invention

The present invention relates to the production of metal pipe, and more particularly, to the production of cast iron pipe with bell ends formed using sand cores.

2. Description of the prior art

In the production of objects such as elongate cast metal pipes, centrifugal casting has been commonly used. In such a casting operation, the pipe is cast in a cylindrical mold. Molten metal, such as iron, is fed into the mold through a trough. The trough has a spout at one end which is curved toward the sidewall of the mold. A sand core is inserted into the bell end of the mold to form the inside contour of the pipe bell. The bell end of the pipe's inside contour typically includes one or more annular grooves or depressions defining a gasket seat area to receive a gasket. The mold is rotated and once it is brought up to the appropriate speed, molten metal is poured into the trough. Once the bell end of the pipe has formed, the mold is moved horizontally while rotating. The stream of molten metal discharged from the spout flows tangentially onto the surface of the mold, where it is held in place by centrifugal force. The molten metal forms a homogeneous pipe with a cylindrical bore.

After the pipe has been completely cast, the mold is kept rotating until the pipe has cooled to a desired temperature. The pipe must then be taken from the casting machine and transferred to a heat treating furnace. In some instances, the sand cores are not removed from the cast pipe before annealing; instead, the sand core is allowed to disintegrate at the temperatures in the annealing oven. However, in other types of production, it is desirable to remove the sand core from the bell end of the pipe before the pipe enters the heat treating furnace. This removal of the sand core is particularly important in plants in which the pipe is set vertically and supported on its bell end in the heat treating furnace; remnant pieces of the sand core could cause the pipe to be off-balance in the furnace, and risks toppling of the pipe.

Traditionally, the sand cores have been manually removed. In the manual process, a worker hits the sand core with a hammer to break the core into smaller pieces, and then scrapes out the pieces of the core using a hoe-type of tool. However, this process has required the worker to be in close proximity to the hot pipe, and has been time consuming, adding to the expense of producing cast iron pipe.

SUMMARY OF THE INVENTION

The present invention addresses the problem of removing sand cores from the bell ends of cast metal pipes.

DETAILED DESCRIPTION

Figure 1:
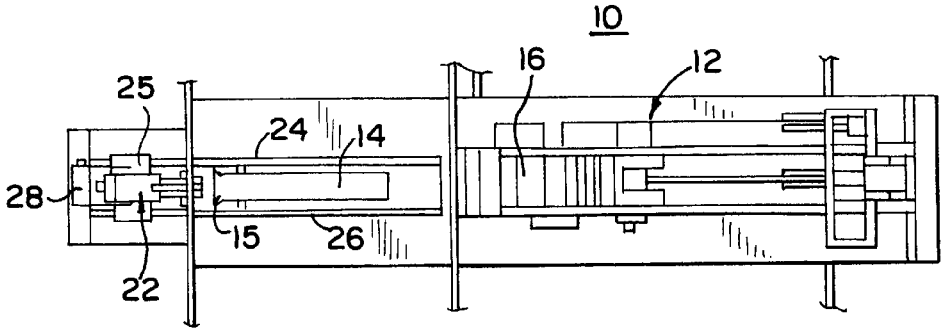
FIG. 1 is a top plan view of an example of a portion of a pipe manufacturing facility illustrating the pipe casting station, with the parts simplified for clarity.

An example of a portion of a manufacturing facility or plant 10 for manufacturing an elongate cast metal pipe such as ductile iron pipe is shown in FIG. 1. The illustrated plant 10 includes a casting station 12 for casting the iron pipe 14. The casting station 12 may include any centrifugal casting machine 16 known in the art. The plant 10 may also include other standard features, such as an annealing or heat-treating station (not shown) downstream from the casting station 12, where the cast iron pipe is heated and cooled to produce the desired properties in the metal. Commonly, the cast iron pipe will be heat treated to produce ductile iron pipe.

The casting machine includes an outer mold that defines the exterior surface of the cast metal pipe 14. A sand core is used to define the contour of the interior surface of the pipe 14 at the bell end 15. An example of an outer mold is shown at 18 in FIGS. 2–5. An example of a sand core is shown at 20 in FIGS. 2–5. It should be understood that the pipe 14, mold 18 and sand core 20 are shown for purposes of illustration only, and that the invention is not limited to the size or shape of pipe, mold and sand core shown unless expressly set forth in the claims.

The sand core typically is made from a mixture of sand and a binder, the binder holding the sand in the form of the core. When the sand core comes into contact with the hot metal in the mold, the part of the core in contact with the metal heats, and the binder is vaporized. Heat is transferred throughout the core, continuing to vaporize the binder.

The present invention is expected to be useful in breaking the continuity of sand cores made from a variety of commercially available binders or other additives. The present invention is also expected to have useful application to varieties of commercially available casting machines, such as the illustrated two-stroke centrifugal casting machine as well as other centrifugal casting machines requiring additional strokes, such as four-stroke casting machines.

Figure 2:
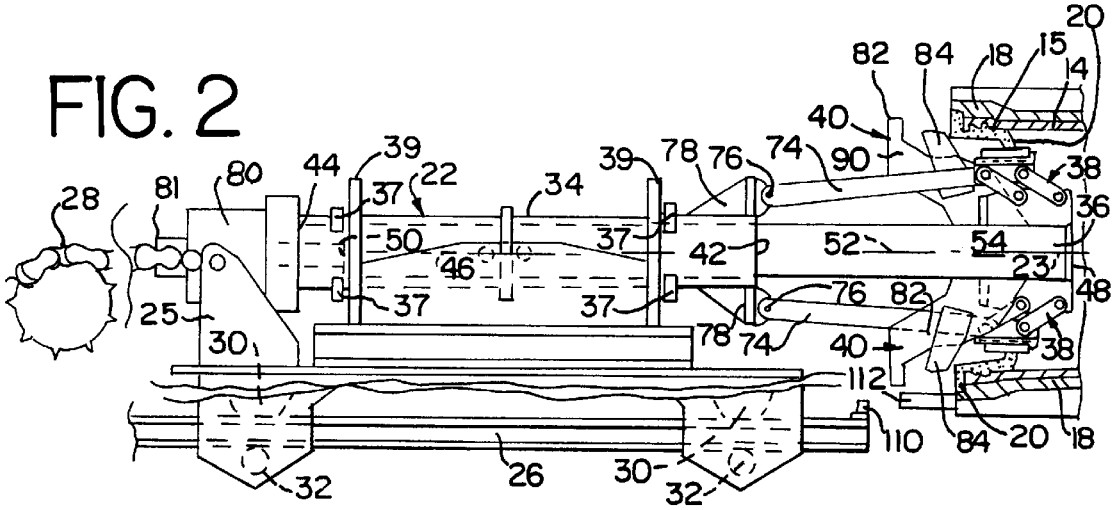
FIG. 2 is a side elevation of an embodiment of an apparatus for breaking the continuity of an annular sand core, the apparatus shown entering the open bell end of the pipe with the extractor jaws retracted, the pipe and sand core being shown in cross-section, the pipe being within the mold of the centrifugal casting machine.
Figure 3:
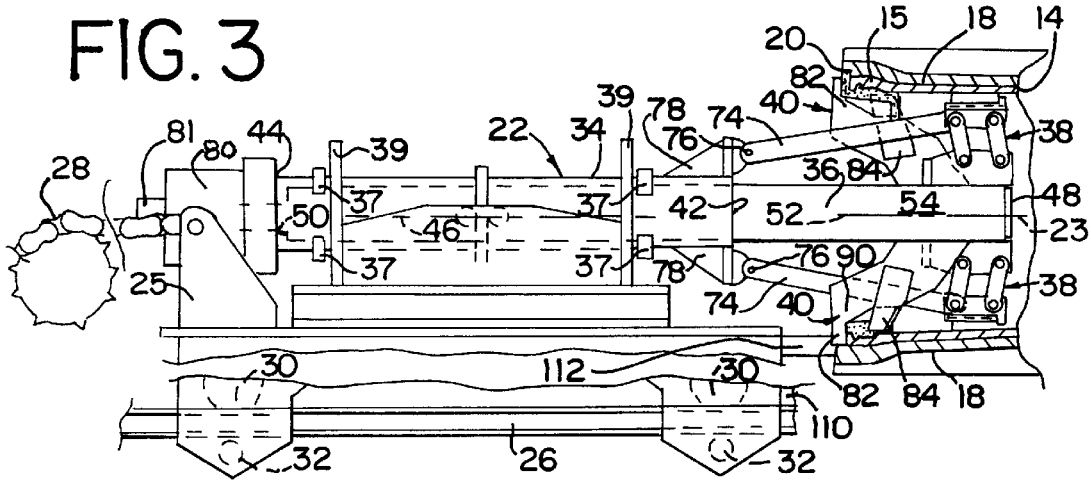
FIG. 3 is a side elevation of the apparatus of FIG. 2, shown with the extractor jaws extended against the inner surface of the pipe to pull the pipe out of the casting mold as the apparatus is withdrawn from the pipe and with part of the sand core broken off by the breaking member of the apparatus.
Figure 4:
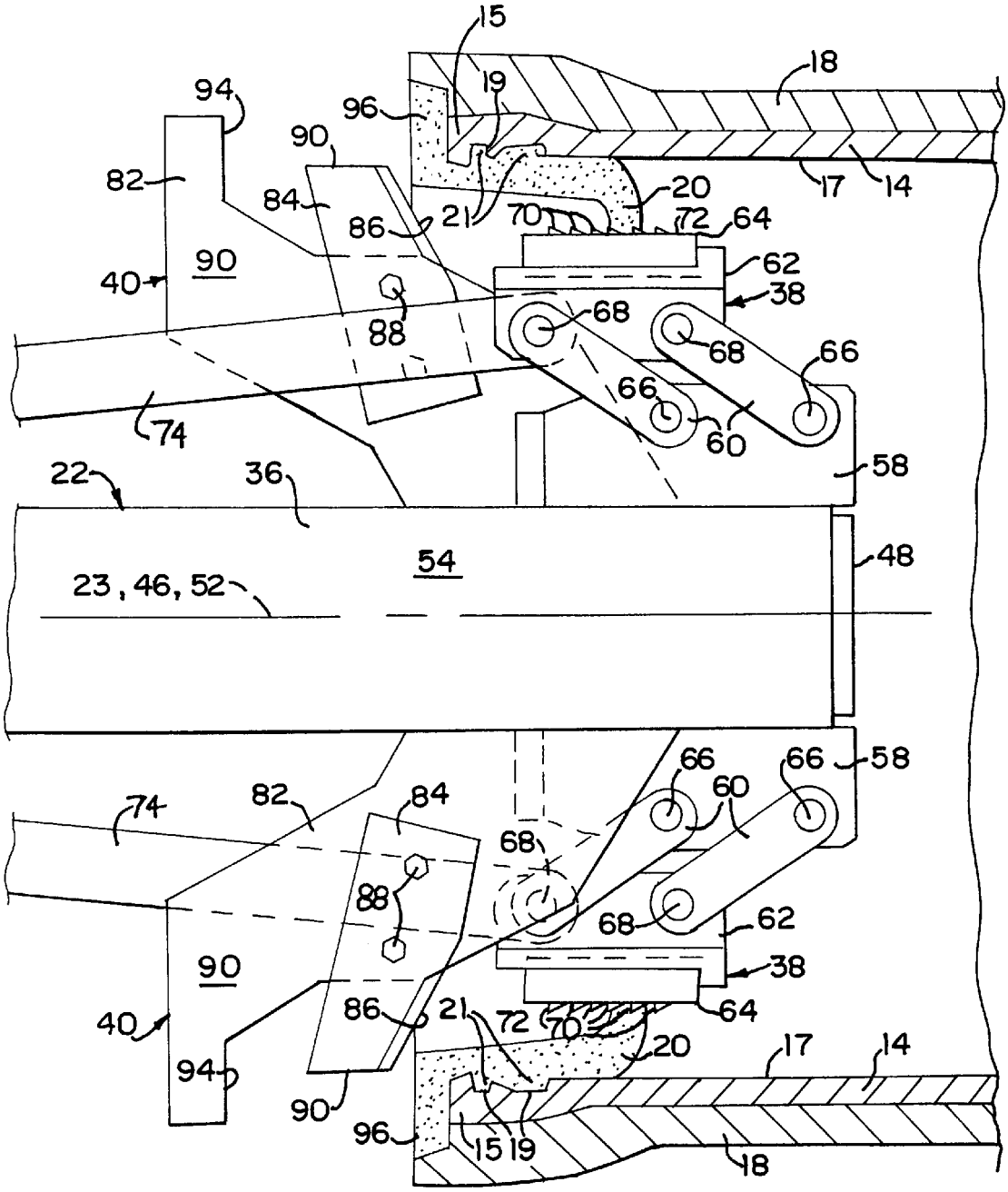
FIG. 4 is an enlarged view of the end of the pipe and apparatus as shown in FIG. 2, with parts removed for clarity.
Figure 5:
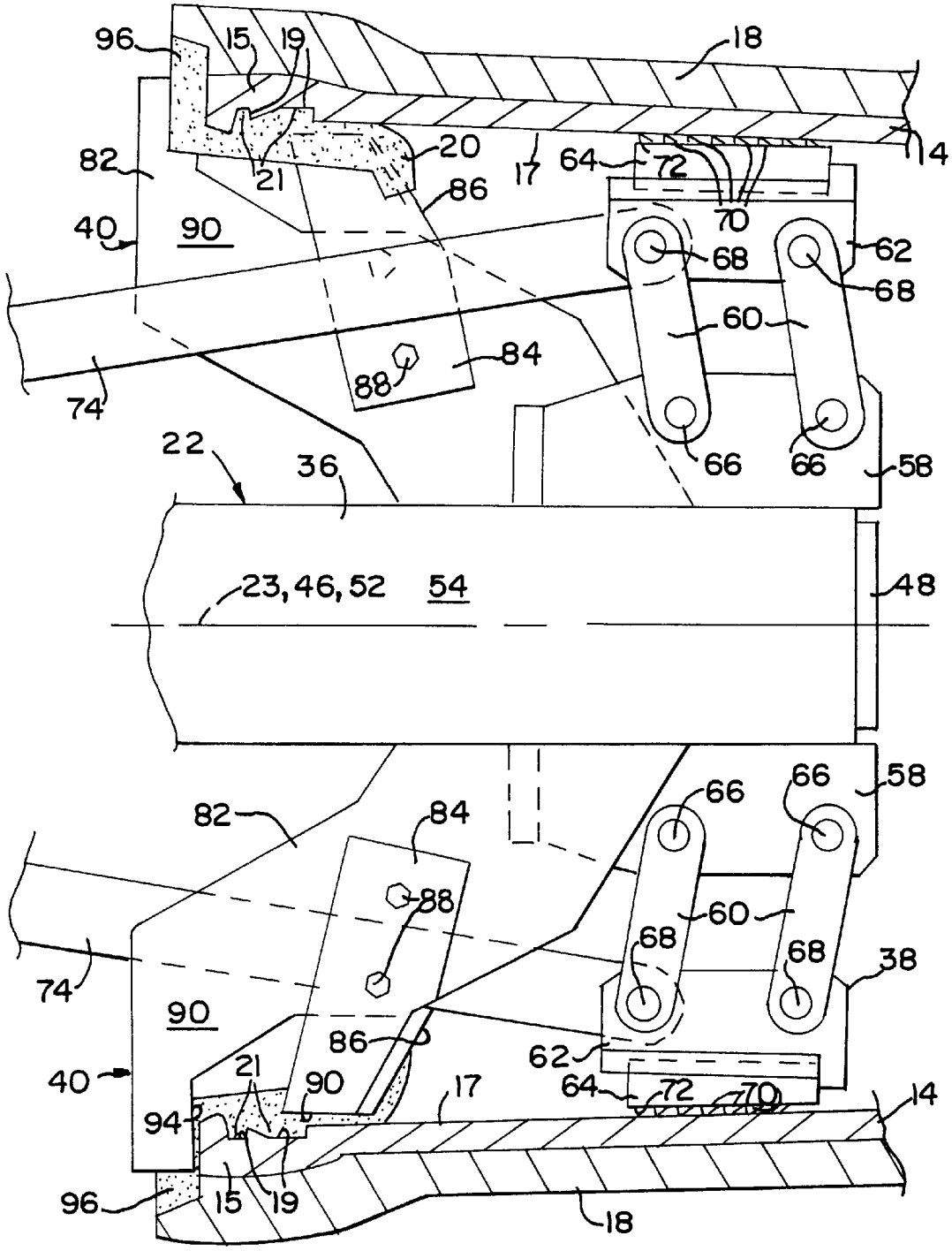
FIG. 5 is an enlarged view of the end of the pipe and apparatus as shown in FIG. 3, with parts removed for clarity.

As shown in FIGS. 2–5, the pipe 14 has an inner surface shown at 17 in FIGS. 4–5. At the bell end 15, the inner surface 17 of the pipe has a contour that includes annular grooves or depressions 19 defining a gasket seat area to receive a gasket. These grooves or depressions 19 are cast around complementary outcroppings shown at 21 in FIGS. 4–5 on the outer surface of the sand core 20. The pipe 14 has a central longitudinal axis shown at 23 in FIGS. 2–5.

To remove the hot cast iron pipe from the mold 18 in the casting machine 16, an extractor apparatus can be used. An example of an apparatus incorporating the principles of the present invention is illustrated in FIGS. 1–6 at 22. The illustrated apparatus 22 is dual function: it provides for extracting the cast pipe from the mold and for breaking the sand core into pieces to facilitate removal of the sand core.

As shown in FIGS. 1–3, the combined pipe-extracting and core-breaking apparatus 22 may be mounted to move longitudinally on a base 25 along spaced rails 24, 26 toward and away from the casting machine 16. The combined apparatus 22 may be connected to be driven by any suitable drive mechanism, such as the drive shown schematically at 28 in FIGS. 1–3. The base 25 of the apparatus may be mounted on wheels 30 supported on the rails 24, 26, and may have stabilizing rollers 32.

A suitable drive mechanism 28 may be, for example a hydraulic or electric motor with a drive chain connected to the base 25, and traveling around sprockets (not shown). Alternatively, a hydraulic cylinder may be used to move the apparatus longitudinally. A suitable hydraulic motor is commercially available from Kawasaki Motors Corp., Precision Machinery Division, of Grand Rapids, Mich., Model HMB270 (No. HMB270/P1/S04/30). However, the invention is not limited to use of a drive mechanism, to a hydraulic drive mechanism, to this particular hydraulic drive mechanism or to one having these characteristics unless expressly set called for in the claims. For example, the apparatus 22 could be manually moved. As discussed below, the apparatus could also be stationary, with the pipe and mold in the casting machine moving relative to the apparatus 22.

As shown in FIGS. 2–3, the illustrated combination pipe-extracting and core-breaking apparatus 22 includes an outer support member 34 and an inner carrier member 36. In the illustrated embodiment, the inner carrier member 36 carries both a plurality of extractor jaw assemblies 38 and a plurality of core continuity breaking members 40. It should be understood that the jaw assemblies and breaking members could be in other positions; for example, both sets of elements could be carried by an outer carrier member that moves relative to an inner support member.

As shown in FIGS. 2–3, in this embodiment, the outer support member 34 is supported near both ends by two sets of rollers 37 that are rotatably mounted on a pair of end rings 39. The end rings 39 are fixed to the base 25. The illustrated outer support member 34 has a first end 42 that is substantially open, a second end 44 and a central longitudinal axis 46. The outer support member 34 is substantially hollow along substantially its entire length to the first end 42, and has a cylindrical inner surface in the illustrated embodiment, although it should be understood that the invention is not limited to this particular shape.

The outer support member 34 may be made of any material suitable for the environment of use, such as mild steel having a wall thickness of about 1 inch, a length of about 66 inches and an outer diameter of about 12 inches. It should be understood that this material and these dimensions are provided by way of example only, and the present invention is not limited to any particular material or dimensions unless expressly set forth in the claims.

In the illustrated embodiment, the inner carrier member 36 has a first end 48, a second end 50, a central longitudinal axis 52 and an outer surface 54. The illustrated inner carrier member 36 is received in the outer support member 34 in a telescoping fashion: it may be moved longitudinally along its axis 52 into and out of the outer support member 34. The inner carrier member 36 extends out through the first end 42 of the outer support member 34. The range of longitudinal motion of the inner member is illustrated in FIGS. 2–3. As shown in FIG. 2, when the inner carrier member 36 is extended out of the outer support member 34, a portion of the inner member extends out beyond the first end 42 of the outer support member 34, and a majority of the length of the inner member 36 is housed within the outer support member 34. As shown in FIG. 3, when the inner carrier member 36 is retracted into the outer support member 34, a shorter portion of the inner member extends out beyond the first end 42 of the outer support member 34, and the majority of the length of the inner member 36 is housed within the outer support member 34.

The inner carrier member 36 may be supported in the outer support member 34, by roller bearings, or through any other support that allows relative longitudinal motion between the members 34, 36. The bearings preferably allow the inner carrier member to move longitudinally along the central longitudinal axes 23, 46, 52. However, the support member 34 restrains pivotal movement of the carrier member 36 about an axis perpendicular to longitudinal axes 23, 46, 52.

The inner carrier member 36 may be made of any material suitable for the environment of use, such as mild steel having a wall thickness of about 1 inch, a length of about 9 feet, and an outer diameter of about 10 inches. It should be understood that this material and these dimensions are provided by way of example only, and the present invention is not limited to any particular material or dimensions unless expressly set forth in the claims.

Figure 6:
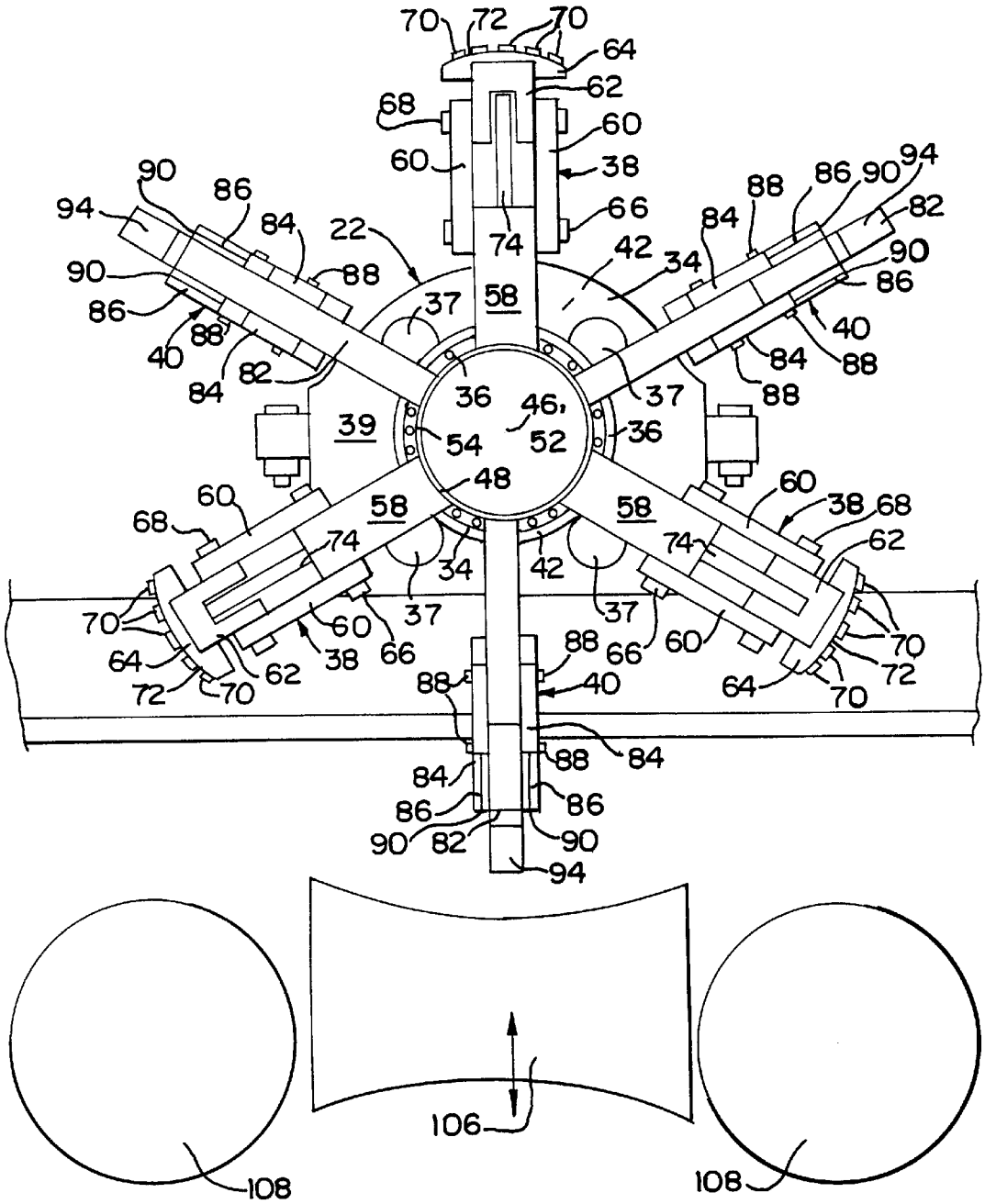
FIG. 6 is an end view of the apparatus of FIGS. 2–5, shown with the extractor jaws extended as in FIGS. 3 and 5.

As shown in FIGS. 4–6, the inner carrier member 36 carries three spaced extractor jaw assemblies 38 in the illustrated embodiment. As shown in FIG. 6, the extractor jaw assemblies 98 extend radially outward from the outer surface 54 of the inner carrier member 36. In the illustrated embodiment, the extractor jaw assemblies are evenly spaced on the inner carrier member 36, although it should be understood that the number and spacing of the extractor jaw assemblies may be varied: fewer or more extractor jaw assemblies may be used; moreover, it is not necessary that the extractor jaw assemblies be positioned as shown and it is not necessary that the extractor jaw assemblies be evenly spaced from each other.

All of the extractor jaw assemblies 38 have the same structure in the illustrated embodiment, and only one will be described. It should be understood that the following description applies to all of the extractor jaw assemblies unless expressly noted.

As shown in FIGS. 4–6, each extractor jaw assembly 38 includes a support base 58, two pair of pivotal extractor jaw tie members 60, a jaw holder 62 and a jaw 64. The support base 58 is fixed to the outer surface 54 of the inner carrier member 36 by welding or other suitable means of attachment, such as through use of mechanical fasteners like nuts and bolts. The two pair of extractor jaw tie plates 60 are rotatably attached to the support base 58 through pins 66. The two pair of extractor jaw tie members 60 are also rotatably attached to the jaw holder 62 through pins 68. The jaw holder carries the jaw 64, which has a plurality of carbide inserts 70 in its bearing surface 72.

As can be seen from a comparison of FIGS. 4 and 5, the pivotal connection provided by the extractor jaw tie members 60 and pins 66, 68 allow the jaw support 62 and jaw 64 to be retracted away from the pipe inner surface 17 and extended toward the pipe inner surface 17 until the inserts 70 on the bearing surface 72 contact the inner surface 17 of the pipe 14. The retracted position is shown in FIGS. 2 and 4 and the extended position is shown in FIGS. 3 and 5.

To move the jaw 64 and jaw support 62 between the positions shown in FIGS. 2–5, an elongate tie plate 74 is pivotally connected at one end to one of the pins 68 that connects the upper pair of tie plates to the jaw support 62. As shown in FIGS. 2–3, the opposite end of the elongate tie plate 74 is pivotally connected to a pin 76 that is mounted on a support structure 78 that is fixed to the outer support member 34 near the first end 42 of the outer support member 34. Thus, as the inner member 36 is extended out of the outer support member 34, the elongate tie bars 74 pull the jaws 64 into the retracted positions shown in FIGS. 2 and 4. As the inner member 36 is retracted into the outer support member 34, the elongate tie bars 74 push the jaws into the extended positions shown in FIGS. 3 and 5 so that the inserts 70 contact the inner wall surface 17 of the pipe 14. The entire apparatus 22 may then be pulled back on the rails 24, 26 by retracting the hydraulic drive 28.

The inner member 36 may be extended and retracted through any suitable drive mechanism, such as a hydraulic cylinder shown schematically at 80 in FIGS. 2–3. The cylinder 80 may be connected to the second end 50 of the inner carrier member 36. A suitable hydraulic cylinder is an Anker-Holth Hydraulic Rotating Cylinder, flange mount, with a 10 inch bore, a 4 inch stroke and with a non-rotating connection for the hydraulic fluid lines, shown at 81 in FIGS. 2–3, available from Anker-Holth of Brampton, Ontario, Canada. However, the invention is not limited to use of a drive mechanism, to a hydraulic cylinder, to this particular hydraulic cylinder mechanism or to one having these characteristics unless expressly called for in the claims. For example, other hydraulic cylinders could be used; motors, hydraulic or electric, and chains could also be used; and the carrier member 36 could be manually moved as well.

The outer member 34 and inner member 36 in the illustrated embodiment are both free to rotate about their central longitudinal axes 46, 52. However, there is no drive mechanism to rotate the outer and inner members 34, 36. Thus, if the pipe 14 is still rotating in the centrifugal casting machine 16 when the apparatus 22 enters the pipe and the jaws 64 are extended into contact with the pipe inner surface 17, the outer and inner members 34, 36 and the extractor jaw assemblies 38 may rotate with the pipe. However, it should be understood that the invention is not limited to such rotatable members unless expressly set forth in the claims.

The components of the extractor jaw assemblies 38 may be made of any material that is suited to the high temperature environment, although the extractor jaw assemblies 38 are generally not inside the hot pipe for a length of time that temperature is problematic. A suitable material is mild steel, but the invention is not limited to any particular material unless expressly set forth in the claims.

As shown in FIGS. 4–6, the inner carrier member 36 carries three spaced core continuity breaking members 40 in the illustrated embodiment. As shown in FIG. 6, the core continuity breaking members 40 extend radially outward from the outer surface 54 of the inner carrier member 36. In the illustrated embodiment, the core continuity breaking members 40 are evenly spaced on the inner carrier member 36, each core continuity breaking member 40 being substantially centered between a pair of extractor jaw assemblies 38. It should be understood that the number and positions of the core continuity breaking members 40 may be varied: fewer or more core continuity breaking members may be used; moreover, it is not necessary that the core continuity breaking members be positioned as shown and it is not necessary that the core continuity breaking members be evenly spaced from each other. It is also not necessary that a core continuity breaking member be positioned between each pair of extractor jaw assemblies 38, or centered between the extractor jaw assemblies 38.

All of the core continuity breaking members 40 have the same structure in the illustrated embodiment, and only one will be described. It should be understood that the following description applies to all of the core continuity breaking members 40 unless expressly noted.

As shown in FIGS. 4 and 5, in the illustrated embodiment each core continuity breaking member 40 comprises a blade assembly. Each illustrated blade assembly includes a blade holder 82 and a blade 84. As shown in FIGS. 2–3, each blade holder 82 is fixed to the outer surface 54 of the inner member 36 between the first end 48 of the inner member and the first end 42 of the outer support member 34 through welding or mechanical fasteners or the like. As shown in FIGS. 2–5, the blade holders 82 are positioned so that the blades 84 enter the pipe end after the retracted extractor jaw assemblies 38 have entered the pipe. The blade holders may be made of mild steel, although the invention is not limited to any particular material unless expressly set forth in the claims.

As shown in FIGS. 4–6, each blade 84 has a leading edge 86 that is sharpened for cutting through the sand core 20 as the core continuity breaking member 40 is moved into the pipe 14. Each leading cutting edge 86 lies in a plane that intersects the central longitudinal axis 23 of the pipe 14. Each blade 84 may be removably attached to the blade holder 82 through bolts 88 or the like. The blade 84 may be made of ¼ inch thick mild steel with the leading edge 86 ground to form the sharp cutting edge, for example. It should be understood that this material and dimension and illustrated shape are provided by way of example only, and the invention is not limited to such a blade or to use of a blade unless expressly set forth in the claims.

As shown in FIGS. 4–6, each illustrated blade 84 has a radial limit 90. In the illustrated embodiment, the radial limit 90 of the blade 84 comprises an edge of the blade that is spaced furthest from the central longitudinal axis 52 of the inner member 36. Generally, the blade holder 82 and blades 84 are sized, shaped and positioned so that the blades can cut through a substantial part of the sand core's radial dimension (the dimension between the inner surface and outer surface of the sand core) while insuring that the blades do not contact the inner surface 17 of the pipe 14. If the blades were to contact the pipe's inner surface 17, particularly in the area of the bell end 15 of the pipe 14, the damage to the pipe could render it of unacceptable quality. Generally, the radial limit 90 of the blade may set to be at a distance of about ⅛ inch from the inner surface 17 of the pipe, with a tolerance of plus or minus 1/16 inch. However, it should be understood that this distance and tolerance are provided by way of example only, and that the present invention is not limited to this distance and tolerance unless expressly set forth in the claims. Thus, although the claims may refer to the radial limits of the blades or to the core continuity breaking member being spaced from the inner surface of the pipe to prevent contact between the core continuity breaking member and the inner surface of the pipe, such references should not be interpreted as any particular distance or tolerance.

In the embodiment illustrated in FIGS. 2–6, the blade holder 82 also includes an extension that trails the blades 84 as the blades enter the pipe. As shown in FIGS. 4–5, the blade holder extension includes a pancake-breaking-portion 94 that comprises an edge that is substantially perpendicular to the central longitudinal axis 52 of the inner member 36 and substantially parallel to the outer surface of the pancake 96 of the sand core 20. The pancake 96 of the sand core 20 is a portion that extends over and defines the outer rim of the bell end 15 of the pipe 14. As shown in FIGS. 4–5, the pancake 96 may extend radially out beyond the inner diameter of the pipe 14 and mold 18, so that the blades 84 may not cut through a substantial part of the pancake 96. The pancake-breaking portion 94 is provided to break the continuity of the sand core's pancake 96.

Figure 7:
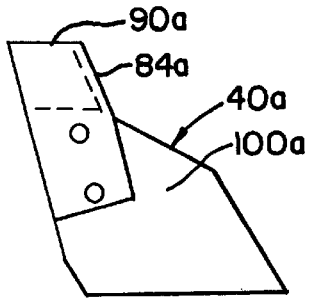
FIG. 7 is a side elevation of an alternative embodiment of a blade and blade holder for a core continuity breaking member.
Figure 8:
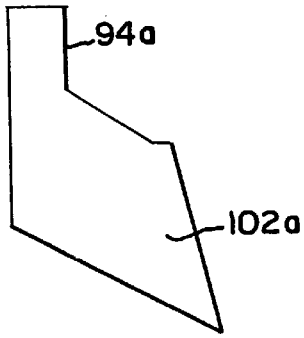
FIG. 8 is a side elevation of an alternative embodiment of a pancake-breaking element that can be attached to the core continuity breaking member of FIG. 7.

A first alternate embodiment of a blade assembly is illustrated in FIGS. 7–8. As shown in FIG. 7, the blade holder need not include the extension and pancake-breaking portion 94 of the first embodiment, and may simply bear the blade 84*a*. As shown in FIG. 8, a separate extension 102*a* may be provided to be attached to the blade holder as desired and in any suitable manner.

Figure 9:
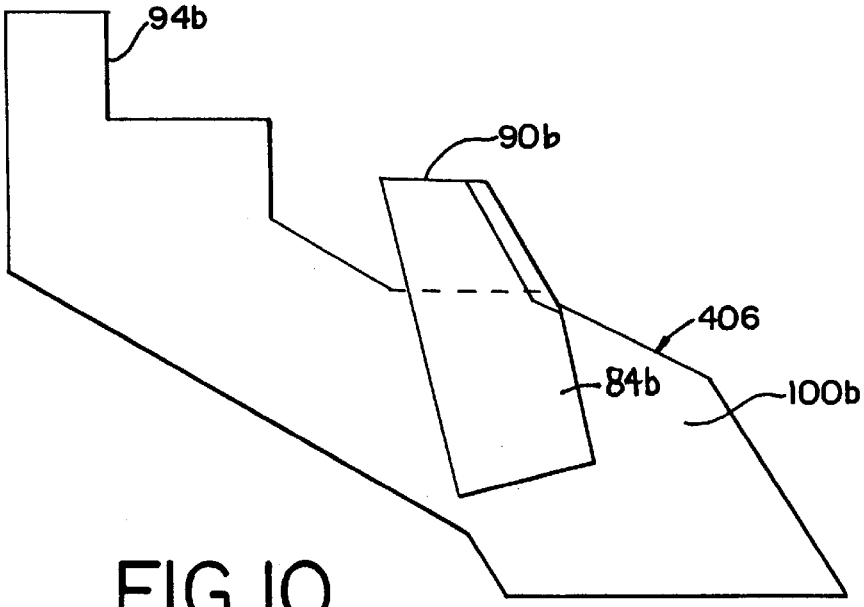
FIG. 9 is a side elevation of an alternative embodiment of a core continuity breaking member.

Another alternative embodiment of a blade assembly is illustrated in FIG. 9. As shown in FIG. 9, the blade holder 100*b* need not be shaped like that shown in the embodiments of FIGS. 1–8. For a different type of pipe end, with a different type of sand core, the blade holder 100*b* may be shaped as desired to break the continuity of the sand core in the most efficient manner. Other variations are possible; for example, additional blades may be included on the illustrated blade holder 100*b*.

Figure 10:
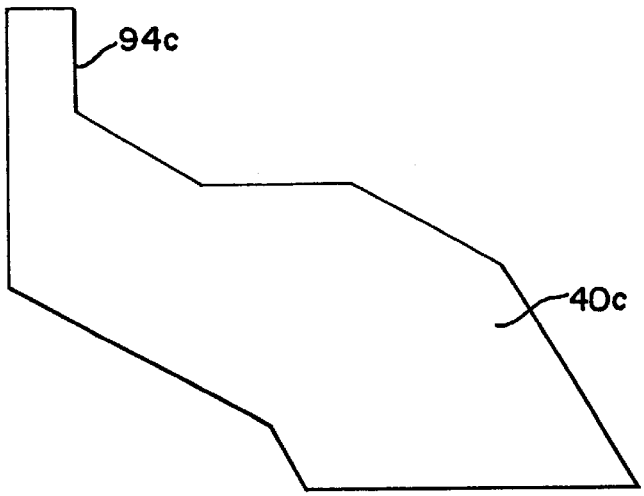
FIG. 10 is a side elevation of another alternative embodiment of a core continuity breaking member.

Another alternative embodiment of a core continuity breaking member is illustrated in FIG. 10. As shown in FIG. 10, the core continuity breaking member 40*c* need not include a portion for breaking the continuity of the inner part of the sand core. Instead, the core continuity breaking member 40*c* may include a pancake breaking portion 94*c* alone.

Other variations are possible. For example, the core continuity breaking members 40 may be attached to the extractor jaw assemblies 38 instead of being spaced from the extractor jaw assemblies 38 as shown. Moreover, although the illustrated embodiment uses three identical core continuity breaking members 40, all of the core continuity breaking members on one carrier member need not be the same. For example, there could be separate core continuity breaking members for breaking the continuity of different parts of the sand core.

Although in the illustrated embodiment the core continuity breaking members have a fixed radial dimension, they could be mounted to structures to allow them to be radially retracted and extended to cut through the sand core. Thus, the continuity of the sand core can be broken when there is no relative longitudinal movement between the pipe and the carrier member by radially extending the core breaking members.

It should be understood that in any of the embodiments, the pancake-cutting portion may comprise a separate blade element that is attached to the blade holder. In addition, since the function of the apparatus is to break the continuity of the sand core so that it will either fall out of the pipe or be more easily removed from the pipe, it is not necessary to provide a blade at all. Moreover, instead of an assembly, the core continuity breaking member 40 could comprise a simple integral plate that plows through and breaks the continuity of the sand core. Preferably, the continuity of the sand core is broken at several locations, as in the illustrated embodiment, but the present invention is not limited in the number of breaks or breaking members unless expressly set forth in the claims.

Many variations in the structure of the apparatus are possible and should be understood as falling within the scope of the invention unless expressly excluded. For example, the carrier member could comprise an outer tube and the support member could comprise an inner tube. Or, instead of a single elongate outer tube serving as a support member, a series of spaced brackets or tubes could be used for support of the carrier member. The carrier member could have another shape as well, and need not be tubular in shape.

As shown in FIG. 6, the system includes pipe supporting rollers. The illustrated system includes retractable hourglass-shaped rollers 106 for initially supporting the pipe as it exits the pipe casting machine 16. After the entire pipe has been drawn out of the casting machine, the hourglass-shaped rollers 106 may be retracted and the pipe supported on rotatable rollers 108. The rotatable rollers 108 may be rotated to rotate the pipe to maintain the roundness of the hot pipe. The pipe may then be moved by a crane or other device to a position downstream in the plant, such as to the annealing oven or to a cleaning station for further cleaning of the waste sand from the bell end of the pipe.

In operation, the sand core 20 is placed at the bell end of the mold 18 and the pipe 14 is centrifugally cast in the casting machine 16, with metal forming around the outer surface of the sand core 20. The pancake 96 of the sand core 20 seals the end of the mold. After the pipe is cast, the drive mechanism 28 is activated to move the combination pipe-extracting and core-breaking apparatus 22 longitudinally on the rails 24, 26 toward the casting machine 16. During this longitudinal movement of the apparatus 22, the inner member 36 is kept in the extended position shown in FIGS. 2 and 4 so that the extractor jaws 64 are retracted. With the jaws retracted, the first end 48 of the inner member 36 enters the bell end 15 of the pipe 14, followed by the retracted jaws 64, followed by the blade holders 82 and the blades 84. The core continuity breaking members 40 are sized, shaped and positioned so that at least part of the core continuity breaking member 40 contacts the sand core 20 during this relative longitudinal movement between the core continuity breaking member 40 and the pipe 14 to break the continuity of at least a part of the sand core 20. When the core continuity breaking members 40 include blades as shown, the sharpened leading edges 86 of the blades slice through a substantial part of the radial dimension of the sand core. The radial limits 90 of the blades stay spaced from the inner surface 17 of the pipe so that the inner surface is not scored or damaged by the blades 84. The blade holders 82 are also spaced from the inner surface 17 of the pipe throughout this longitudinal movement of the apparatus 22 and core continuity breaking members 40.

Forward longitudinal movement of the apparatus 22 and the blade holder also causes the pancake-breaking portions 94 of the blade holders 82 to plow through portions of the pancake. This forward longitudinal movement of the apparatus stops before the pancake-breaking portions 94 of the blade holders 82 contact the rim at the bell end of the pipe. As shown in FIGS. 2–3, the rails 24, 26 or some other structure may include stop blocks 110 to block forward movement of the apparatus 22 at a preselected position. The stop blocks 110 could be fixed in position in any standard manner, such as by welding. A positive stop may be fixed to the casting machine, such as shown at 112 in FIGS. 2–3; the length of this stop 112 sets a predetermined longitudinal distance between the end of the pipe in the casting machine and the blade holders 82 to prevent contact between the blade holders 82 and pancake-breaking portion 94 with the end of the pipe 14. It should be understood that other devices could be used as well, such as a position sensor that is tied through a logic element to control the drive mechanism 28. It might also be desirable to include a position sensor to sense the position of some part of the mold 18, sand core 20 or pipe 14 and to control movement of the drive mechanism 28 through a logic element based upon the sensed position of the mold 18, sand core 20 or pipe 14.

After the apparatus has stopped its forward longitudinal movement, the hydraulic mechanism 80 may be activated to withdraw the inner carrier member 36 into the outer support member 34. As the inner carrier member 36 is withdrawn, the elongate tie plates 74 force the jaws to extend outward and the jaw bearing surface 72 or jaw inserts 70 contact the inner surface 17 of the pipe wall. The drive mechanism 28 may then be activated to pull the entire apparatus 22 and pipe 14 longitudinally away from the casting machine 16. As the pipe 14 is pulled from the mold 18 in the centrifugal casting machine 16, the pipe 14 is supported on the hourglass-shaped rollers 106.

Since the blades 84 have cut though substantial parts of the radii of the sand core, breaking its continuity within the pipe, and since the portions 94 of the blade holder 82 have broken the continuity of the sand core pancake 96 at several locations, the structural integrity of the sand core is destroyed and it falls from the pipe. The hourglass rollers 106 may be retracted so that the pipe then rests on the rollers 108, which may be rotated to rotate the pipe to preserve pipe roundness. The pipe may then be moved to another station for further cleaning of the bell end of the pipe and for treatment of the pipe, such as heat treatment in an annealing furnace.

For different diameters of pipe, the apparatus 22 may have interchangeable extractor heads. Each extractor head could comprise the inner carrier member 36, the set of extractor jaw assemblies 38 connected to the inner carrier member 36, and the core continuity breaking members 40 fixed to the inner carrier member 36. The elongate tie plates 74 could also be part of each extractor head. The shape, dimensions and number of the extractor jaw assemblies 38 and core continuity breaking members 40 attached to the inner carrier member 36 could be varied depending upon the pipe dimensions. The extractor heads could be changed by removing the pins 68 connecting the elongate tie members 74 to the extractor jaw assemblies 38 and then sliding the entire inner carrier member 36 out of the outer support member 34 and then sliding a new extractor head into the outer support member 34 and connecting the elongate tie members 74 to the extractor jaw assemblies 38 of the new extractor head through the pins 68. Alternatively, pins 76 could be removed and the elongate tie members 74 changed with the extractor head.

Alternate extractor heads are also possible. For example, each extractor head could comprise a relatively short sleeve section that telescopes over the first end 48 of the inner carrier member 36 and is then fixed at the end of the inner carrier member with set screws, clamps or the like. The extractor jaw assemblies 38 and core continuity breaking members 40 could be fixed to the short sleeve section by welding or the like. Alternatively, the extractor jaw assemblies 38 and core continuity breaking members could be individually mounted on the end of the inner carrier member 36 and removably fixed thereon through bolts, set screws, clamps or through some other mechanical mounting mechanism. Slots could be formed in the inner carrier member 36 to receive the assemblies 38 and members 40.

It should be understood that the present invention is not intended to be limited to any particular type of extractor head assembly unless expressly set forth in the claims. It should also be understood that references to the extractor jaw assemblies 38 and core continuity breaking members 40 being fixed to the carrier member 36 or to the outer surface of the carrier member 36 are intended to include embodiments wherein the extractor jaw assemblies 38 and core continuity breaking members 40 are fixed directly to the carrier member 36 by welding or some mechanical connection, as well as though connection to another element such as a sleeve that is itself fixed to the carrier member 36 through welding or through some mechanical connection. It should also be understood that references to the extractor jaw assemblies 38 and core continuity breaking members 40 being fixed to the carrier member 36 or to the outer surface 54 of the carrier member 36 are intended to include removable connections such as provided through nuts and bolts, screws or other mechanical connections.

Although described and shown in the form of an apparatus and method that combines pipe extraction with core breaking, the invention is not intended to be limited to such combinations unless expressly set forth in the claims. For example, it may be desirable in some instances to perform these operations in separate steps: one apparatus could be provided for pipe extraction and a second apparatus may be provided for breaking the sand core, with the step of breaking the sand core either preceding or following extraction of the pipe from the mold.

The principles of the present invention may be applied to other types of pipe casting and extraction systems. For example, instead of moving the extraction assemblies and core breaking assemblies longitudinally into the pipe, the pipe in the mold in the casting machine could be moved longitudinally toward and over the extraction assemblies and core breaking assemblies. The invention encompasses both two-stroke and four-stroke centrifugal casting machines. The invention is intended to encompass any relative longitudinal movement between these elements unless the claims expressly call for movement of a particular element in a particular direction.

It should be understood that although described in context of making cast iron pipe that is later heat-treated to form ductile iron pipe, the principles of the present invention may be applied to the production of other cast metal pipe and other cast metal objects.

The apparatus and method of the present invention may be computer controlled. A computer or programmable logic component may be connected to receive input such as an electrical signal from the casting machine or from a sensor such as a limit switch to sense when the casting machine has reached a preset position. The programmable logic component can be connected through outputs to control operation of the drive mechanism 28 to move the entire apparatus 22 along the rails 24, 26 and to control operation of the drive mechanism 80 to move the member 36. The programmable logic component could also be connected to control operation and movement of the pipe supporting rollers 106, 108. Alternatively, a separate programmable logic component could control the pipe supporting rollers 106, 108.

A commercially-available programmable logic component may be used. A suitable programmable logic and motion control system is available from Allen-Bradley Co./Rockwell Automation, of Milwaukee, Wis. and other locations, with standard logic suitably programmed, as will be understood by those skilled in the art. It is expected that the supplier would be consulted for selection of an appropriate model of component. A standard PLC with standard logic may be programmed by one skilled in the programming art, such as an electrical engineer, or more sophisticated programming could be developed if desired. It should be understood that this computer control is identified for purposes of illustration only, and that the invention is not limited to use of programmable logic components, to components from this supplier, or to any particular program, computer or PLC.

While only a specific embodiment of the invention has been described and shown, it is apparent that various alterations and modifications can be made therein. It is, therefore, the intention in the appended claims to cover all such modifications and alterations as may fall within the scope and spirit of the invention. Moreover, the invention is intended to include equivalent structures and structural equivalents to those described herein.

I claim:

1. An apparatus for breaking the continuity of an annular sand core in the interior of a hollow cast metal pipe, the pipe having an inner surface with an inner diameter and a central longitudinal axis;

the annular sand core in contact with a portion of the interior surface of the hollow cast metal pipe;

the apparatus comprising:

a carrier member, a support member supporting at least a part of the carrier member, and at least one core continuity breaking member extending from the carrier member;

the carrier member being longitudinally moveable along the central longitudinal axis of the pipe such that a portion of the carrier member enters the interior of the hollow cast metal pipe;

the core continuity breaking member being sized, shaped and positioned so that at least part of the core continuity breaking member contacts the sand core during relative longitudinal movement between the core continuity breaking member and the pipe to break the continuity of at least part of the sand core, wherein at least one of the support and carrier members is free to rotate with any rotation of the pipe about the central longitudinal axis of the pipe, the support member restraining pivotal movement of the carrier member about another axis.

2. The apparatus of claim 1 wherein the sand core includes a pancake portion on the exterior of the pipe and the core continuity breaking member includes a portion for contacting and breaking the continuity of at least a part of the pancake of the sand core.

3. The apparatus of claim 1 wherein the sand core includes a portion within the interior of the pipe and the core continuity breaking member includes a portion for breaking the continuity of the portion of the sand core within the interior of the pipe during relative longitudinal movement between the pipe and the core continuity breaking member.

4. The apparatus of claim 3 wherein the core continuity breaking member is within the interior of the pipe at some times and outside of the interior of the pipe at other times, the core continuity breaking member being spaced from the inner surface of the pipe throughout the relative longitudinal movement of the carrier member and the pipe to prevent contact between the core continuity breaking member and the inner surface of the pipe.

5. The apparatus of claim 3 wherein the core continuity breaking member comprises a blade assembly including a blade holder fixed to the carrier member and a blade removably attached to the blade holder.

6. The apparatus of claim 5 wherein the blade has a radial limit that is spaced from the inner surface of the pipe.

7. The apparatus of claim 3 wherein the sand core includes an integral pancake portion on the exterior of the pipe and wherein the core continuity breaking member includes a portion for contacting and breaking the continuity of at least a part of the pancake of the sand core.

8. The apparatus of claim 1 further including an extractor assembly carried by the carrier member at a position spaced from the core continuity breaking member.

9. The apparatus of claim 1 wherein:

the support member comprises an elongate tube with a first end, a second end and a longitudinal axis, the support member being hollow along at least a part of its length to the first end and the first end of the support member being at least partially open; and the carrier member having a first end and a second end, at least a part of the carrier member being carried within the support member, the carrier member extending through the opening in the first end of the support member, the first end of the carrier member and at least part of the carrier member extending beyond the first end of the support member.

10. The apparatus of claim 9 wherein the apparatus is longitudinally moveable and the carrier member is longitudinally moveable into and out of the support member.

11. The apparatus of claim 1 wherein the carrier member has an outer surface and a longitudinal axis and the core continuity breaking member extends radially outward from the outer surface of the carrier member.

12. The apparatus of claim 1 wherein there are a plurality of core continuity breaking members extending radially outward from the carrier member.

13. The apparatus of claim 12 wherein there are a plurality of extractor assemblies extending radially outward from the carrier member.

* * * * *